US005377914A

United States Patent [19]

Christen

[11] Patent Number: 5,377,914

[45] Date of Patent: Jan. 3, 1995

[54] SPEED CONTROLLED ROTATING SPRINKLER

[75] Inventor: Hans Christen, La Verne, Calif.

[73] Assignee: Rain Bird Sprinker Mfg., Corp., Glendora, Calif.

[21] Appl. No.: 12,996

[22] Filed: Feb. 3, 1993

[51] Int. Cl.[6] ..... B05B 3/06

[52] U.S. Cl. ..... 239/252

[58] Field of Search ..... 239/251, 252, 680, DIG. 1, 239/259, 587.1, 518, 521, 233.

[56] References Cited

U.S. PATENT DOCUMENTS

| | | | |
|---|---|---|---|
| Re. 33,823 | 2/1992 | Nelson | 239/252 X |
| D. 259,438 | 6/1981 | Meyer . | |
| 2,534,016 | 12/1950 | Grelson | 239/252 |
| 2,991,942 | 7/1961 | Rosenkranz | 239/251 X |
| 2,998,197 | 8/1961 | Kachergis | 239/251 X |
| 3,029,028 | 4/1962 | Skerritt | 239/252 |
| 3,193,203 | 7/1965 | Crow | 239/251 X |
| 3,799,453 | 3/1974 | Hart | 239/680 |
| 4,356,972 | 11/1982 | Vikre . | |
| 4,440,345 | 4/1984 | Figwer et al. . | |
| 4,498,628 | 2/1985 | Tucker . | |
| 4,560,108 | 12/1985 | Rubinstein . | |
| 4,796,811 | 1/1989 | Davisson . | |
| 4,886,211 | 12/1984 | Cohen | 239/252 X |
| 5,007,586 | 4/1991 | Cohen . | |

*Primary Examiner*—Andres Kashnikow
*Assistant Examiner*—Kevin P. Weldon
*Attorney, Agent, or Firm*—Kelly, Bauersfeld & Lowry

[57] ABSTRACT

A spinner type irrigation sprinkler having a support bridge to which is coupled a spinner assembly for rotation about a vertical axis, the spinner assembly including a spinner body and an adjustable trajectory nozzle assembly with a removable nozzle member, the spinner body coupled to a brake module attached to the bridge and employing viscous fluid shear to control the speed of rotation of the spinner assembly and attached nozzle member.

27 Claims, 5 Drawing Sheets 22
126

138
164
160
10
158
122
150
154
146
52
16
4
94
54
84
72
70
76
50
92
88
74
44
86
36
64
68
18
90
80
66
46
4
56
32
58
48
34
62
14
30
60
24
28
26

FIG. 4
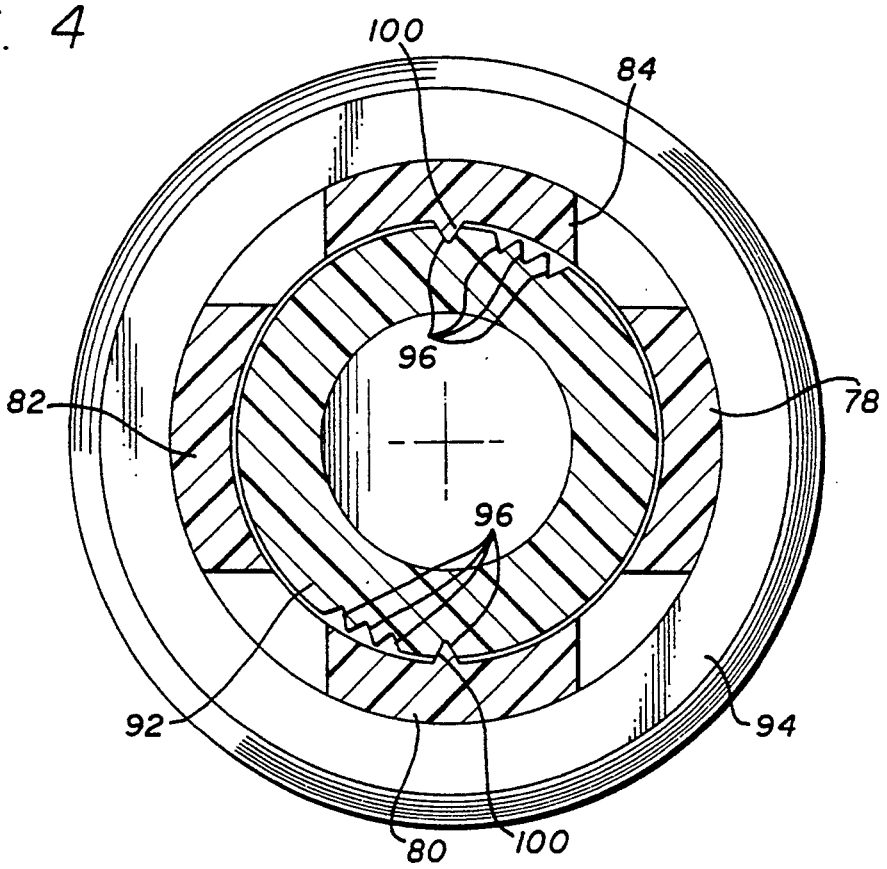
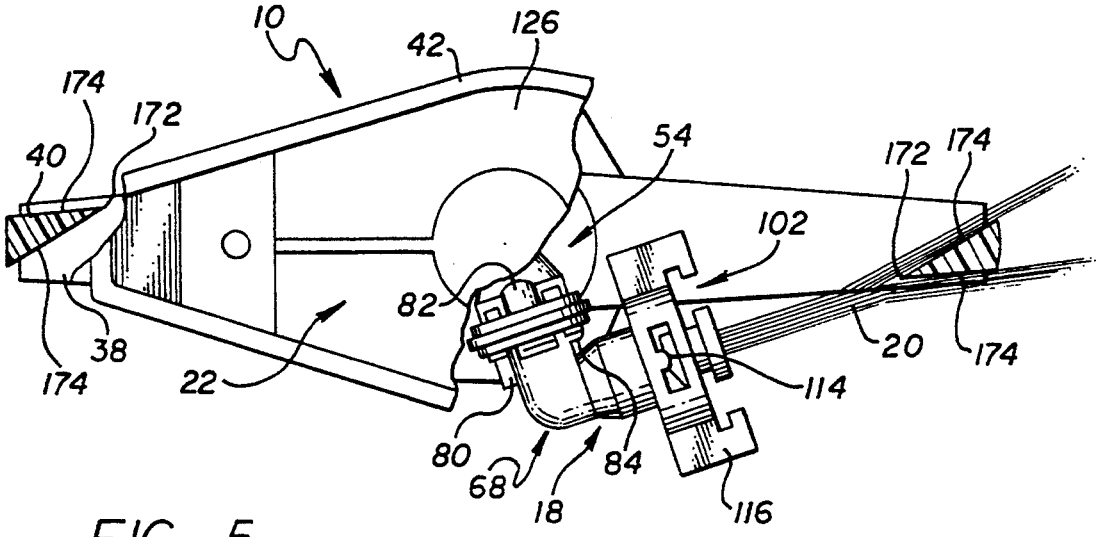
FIG. 5

SPEED CONTROLLED ROTATING SPRINKLER

BACKGROUND OF THE INVENTION

This invention relates to irrigation sprinklers, and more particularly, to a new and improved sprinkler construction for sprinklers of the type generally referred to as "spinners".

There are many different types of rotary sprinkler constructions used for irrigation purposes, including impact or impulse drive sprinklers, motor driven sprinklers, and rotating reaction drive sprinklers. Included in the category of rotating reaction drive sprinklers are a species of sprinklers known as a "spinner" and which has found particular application in the irrigation of agricultural crops and orchards.

Typically, such spinner type sprinklers comprise a stationary support structure or "bridge" which is adapted to be coupled with a supply of pressurized water, and a rotating sprinner drive supported by the bridge for rotation about a generally vertical axis. Most spinner type sprinklers employ either a rotating reaction drive nozzle to form the spinner device, or employ a fixed nozzle which ejects a stream of water vertically onto a rotating deflector which redirects the stream into a generally horizontal spray, the deflector being rotated by a reaction force created by the impinging stream from the fixed nozzle. Exemplary of such prior art spinner type sprinklers are those disclosed in U.S. Pat. Nos. 4,356,972; 4,440,345; 4,498,628; 4,660,766; 4,796,811; and 5,007,586.

One problem that has been encountered with spinner type sprinklers is that due to a very high rate of rotation of the spinner devices, the distance water is thrown from the sprinkler may be substantially reduced. To correct this problem, the prior art has recognized that brake mechanisms, typically employing the principle of viscous fluid shear, can be added to the sprinkler to very substantially reduce the rate of spinner rotation, thereby increasing the area covered by the sprinkler. Such brake mechanisms are disclosed, for example, in the spinner type sprinklers of the aforementioned U.S. Pat. No. 4,440,345 relating to a rotary nozzle type spinner, and U.S. Pat. No. 4,660,766 relating to a fixed nozzle with rotating deflector type spinner.

The present invention is directed to a new and improved construction for a spinner type sprinkler, particularly of the type employing a rotating reaction drive nozzle, which significantly increases the operational range and capabilities of such sprinklers, and provides a substantial increase in performance over prior art spinners, particularly over such spinners employing fixed nozzle with rotating deflector type constructions.

SUMMARY OF THE INVENTION

In accordance with the present invention, a new and improved spinner type irrigation sprinkler construction is provided which permits the user to select and control the angle of trajectory of the water stream ejected by the sprinkler nozzle, and which permits the user to quickly and easily change nozzle sizes to meet a wide variety of operational conditions and demands. Further, the present invention provides a brake mechanism to control and optimize the rate of spinner rotation while still permitting the user to select from a very wide range of nozzle sizes and capacities without loss of speed control.

More particularly, the spinner type sprinkler of the present invention includes a sprinkler assembly mounted for rotation about a generally vertical axis to a support bridge adopted to be coupled to a pressurized source of water. The spinner assembly includes a spinner body to which is coupled a reaction drive nozzle assembly selectively movable between preset trajectory angle positions whereby the water stream from the nozzle assembly can be horizontally away from the sprinkler a preselected angle relative to the vertical axis of rotation. In this respect, the nozzle assembly includes a generally L-shaped tubular elbow having a first end rotatably coupled to the spinner body to project laterally therefrom, and a second end to which a nozzle member is attached so as to project a water stream in a direction generally tangent to the axis of rotation. Detent means are provided between the spinner body and the first end of the elbow, and which secure to hold the elbow in preselected rotary positions for trajectory angel control. A lock collar is releasably secured over the detent means to lock the elbow in a selected rotary portion, and which is movable to an unlock position to permit the detent means to be released and the elbow rotated relative to the spinner body. Further, the nozzle member is releasably coupled to the elbow by a bayonet-type connection which permits the user to quickly and easily change the nozzle size, thereby to increase the capacity and range of the sprinkler.

To control the speed of rotation of the spinner assembly, a brake module is releasably coupled to the support bridge and spinner body. The brake module operates on the principle of viscous fluid shear, and different modules having different braking capabilities can be easily mounted to the sprinkler so that the effective operational range of nozzle sizes and supply pressures are increased without loss of speed control. The brake module includes a brake housing releasably coupled to the support bridge above the spinner body, and defines a cylindrical chamber within which a brake rotor and viscous fluid are disposed. The brake rotor is releasably coupled to the spinner body for rotation therewith. To change the braking characteristics of the spinner, all that is required is that the one brake module be released from the bridge and spinner body, and another having different braking characteristics be reattached in its place.

A still further feature of the present invention relates to the support bridge construction which includes a pair of upstanding support posts extending between a lower base portion and an upper bridge plate to which the brake module is attached. The spinner assembly is rotatably mounted between the brake module and the lower base portion of the support bridge and rotates between the posts which are impinged by the water stream from the nozzle member as the nozzle assembly rotates. To minimize water stream disruption and splashing, the support posts which have a generally triangular horizontal cross section, are rotated so that the radially inwardly converging sides terminate at an axis which is formed along a plane tangent to the axis of rotation of the spinner body. With this construction, water from the nozzle member will be evenly split around the support posts with a minimum of splash and disruption.

These and many other features and advantages of the present invention will become more apparent from the following detailed description taken in conjunction with the accompanying drawings which disclose, by way of example, the principles of the invention.

BRIEF DESCRIPTION OF THE DRAWINGS

FIG. 4 is an enlarged cross-sectional view taken substantially along line 4—4 of FIG. 3;

FIG. 5 is a top plan view, partly in cut-away cross-section of the spinner type irrigation sprinkler of FIG. 2, as viewed in the direction of line 5—5 of FIG. 2;

DETAILED DESCRIPTION OF THE PREFERRED EMBODIMENT

Figures 7, 7A, 7B:
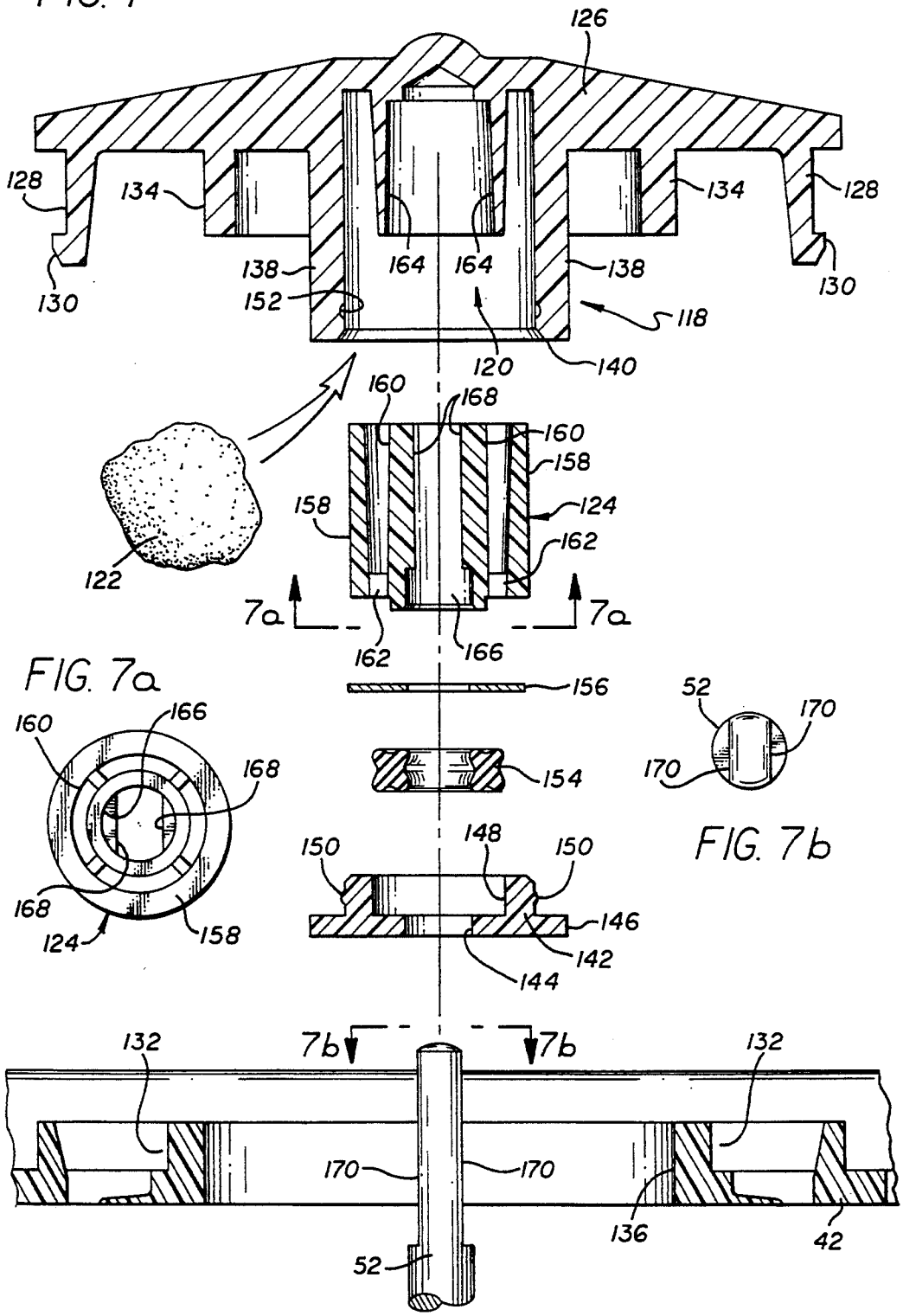
FIG. 7 is an enlarged fragmentary exploded cross-sectional view of the brake module as seen in the circle depicted by line 7—7 of FIG. 2.
FIG. 7*a* is a cross-sectional view taken substantially along line 7*a*—7*a* of FIG. 7.
FIG. 7*b* is a cross-sectional view taken substantially along line 7*b*—7*b* of FIG. 7.

As shown in the exemplary drawings, the present invention is embodied in a new and improved rotary sprinkler 10 of the "spinner" type primarily intended for use in applying water to agricultural crops and orchards. In this instance, the sprinkler 10 is shown coupled to the end of an upstanding water supply riser 12 through which water from a suitable pressurized source is provided, and comprises, in general, a stationary support bridge 14 coupling the sprinkler to the riser, a spinner assembly 16 including a reaction drive rotary nozzle assembly 18 for projecting water outwardly from the sprinkler as a water spray 20, and a brake assembly 22 (best seen in FIGS. 2, 3, and 7) for limiting the rate of rotation of the nozzle assembly. It should be noted that although the sprinkler 10 is illustrated in FIG. 1 as being disposed in an upright position on the riser 12, the sprinkler can also be mounted in an inverted position, such as may be required for use on a wheel-line or center-pivot type irrigation system.

Figure 1:
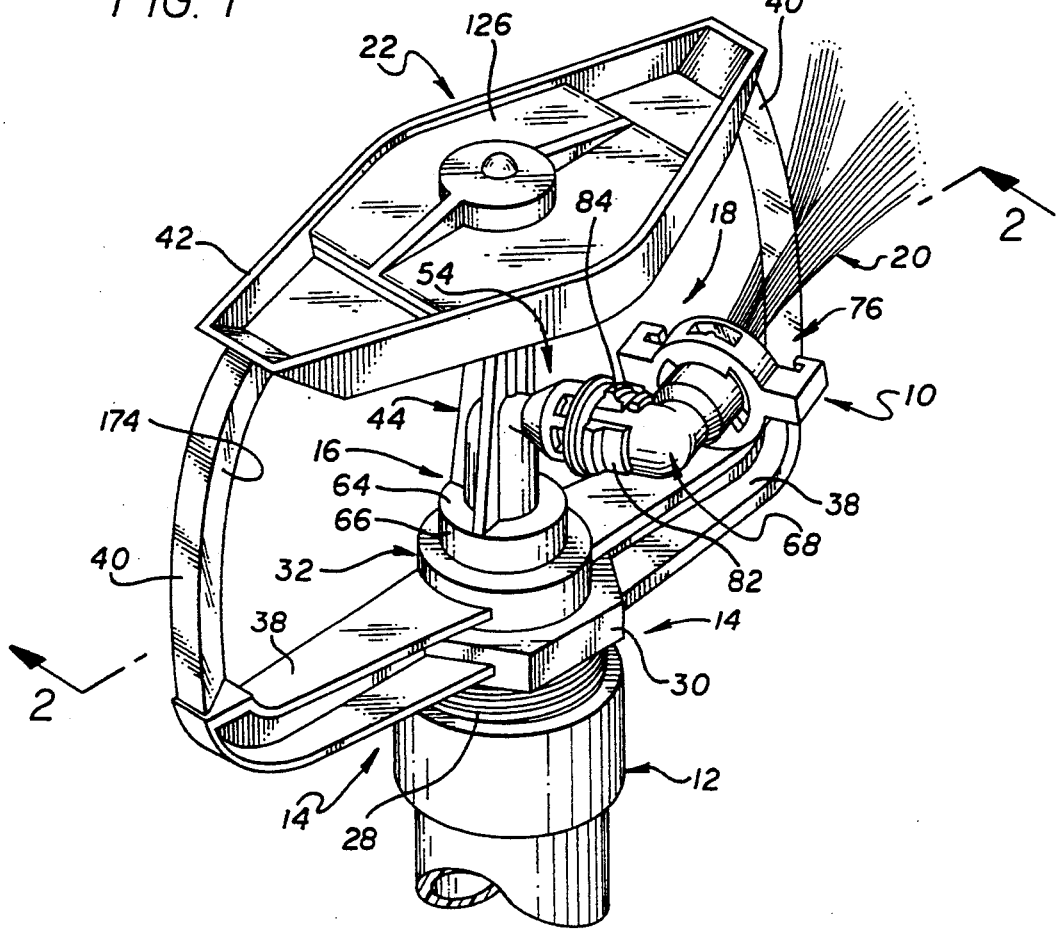
FIG. 1 is a fragmentary perspective view of a spinner type irrigation sprinkler embodying the principles of the present invention, and shown mounted for operation to a water supply pipe.
Figure 2:
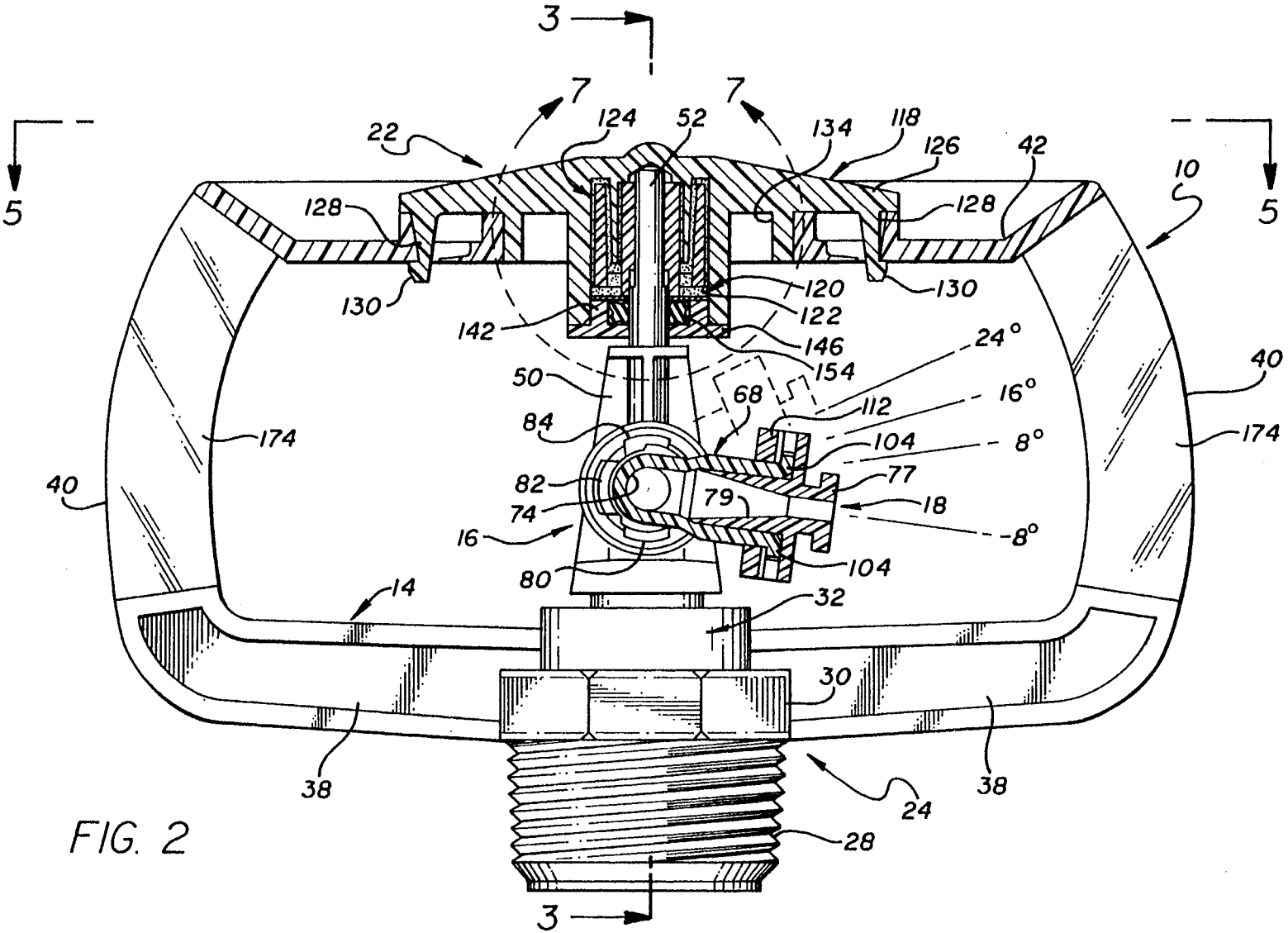
FIG. 2 is an enlarged side cross-sectional view taken substantially along the line 2—2 of FIG. 1.
Figure 3:
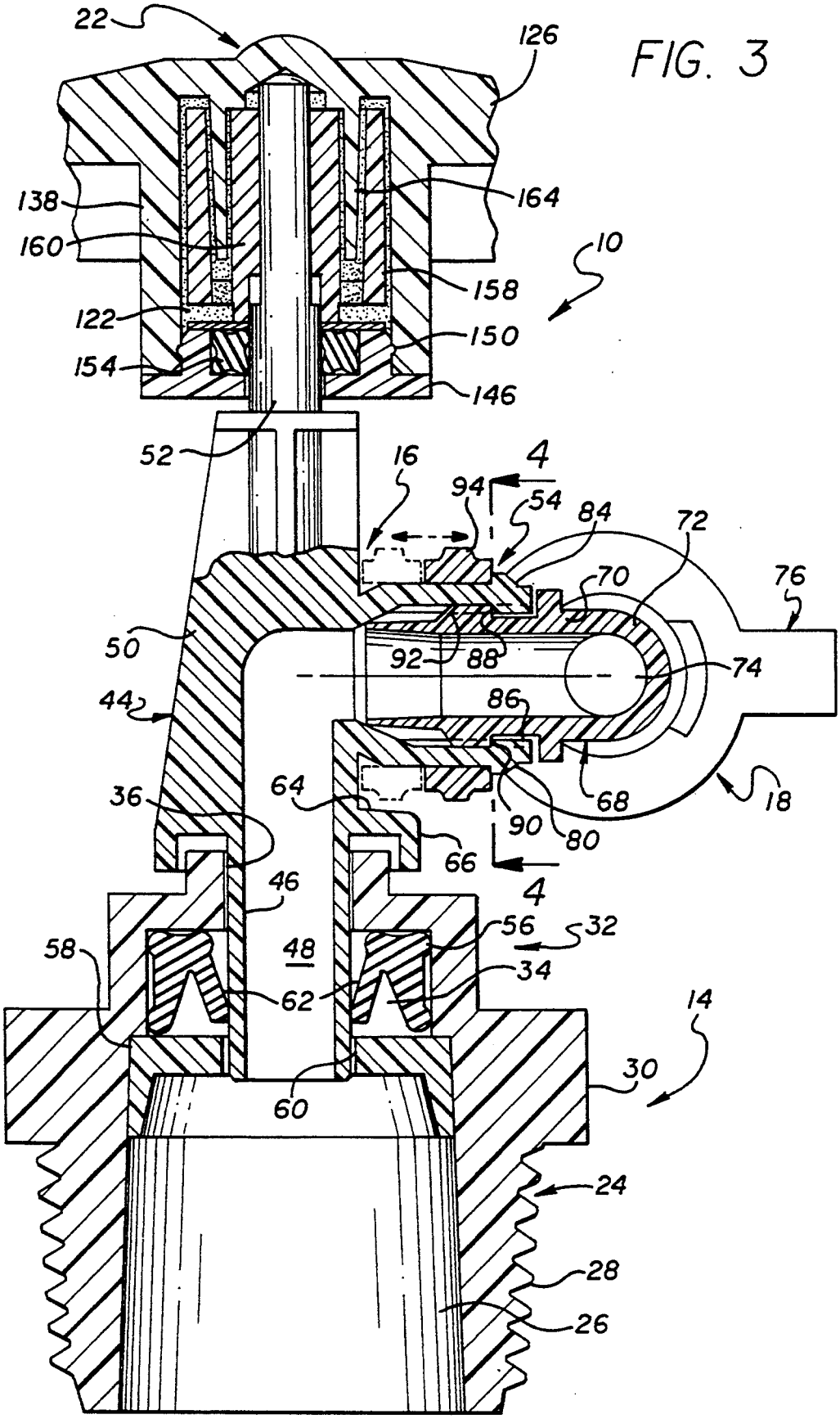
FIG. 3 is a further enlarged cross-sectional view taken substantially along line 3—3 of FIG. 2.

With reference to FIGS. 1 through 3, the bridge 14 herein comprises a lower tubular body portion 24 defining an internal cylindrical water passageway 26 through which water from the riser 12 is admitted to the sprinkler 10, and which is provided with external threads 28 for threadably securing the sprinkler to the riser. Herein, a hex-nut shaped flange 30 extends outwardly around the lower body portion 24 above the threads 28, and is provided to facilitate tightening and loosening of the threaded connection with the riser 12. Disposed above the flange 30 is an inwardly stepped cylindrical portion 32 defining an internal central cylindrical cavity 34 and thereabove, a bearing and support sleeve opening 36 which functions as a bearing and support for the lower end of the spinner assembly 16. Projecting radially outwardly from diametrically opposed sides of the lower body portion 24 are a pair of horizontal support struts 38 which terminate outwardly in upstanding vertical posts 40, the upper ends of which are connected to a horizontally disposed elongated support plate 42 to which the brake assembly 22 is centrally attached. Preferably, the lower body portion 24, struts 38, posts 40 and support plate 42 forming the bridge 14 are integrally formed as a single unit, such as by molding the bridge from a suitable plastic material.

The spinner assembly 16 is rotatably mounted at its lower end to the bridge 14, and at its upper end, the spinner assembly is coupled to the brake assembly 22 so that the spinner assembly is rotatable about a vertical axis extending along the center line of the cylindrical water passageway 26 defined by the lower body portion 24 of the bridge 14. As best seen in FIG. 3, the spinner assembly 16 includes a spinner body 44, preferably formed of molded plastic, comprising a tubular lower end portion 46 having an outside diameter dimensioned to be rotatably received through the bearing sleeve opening 36 in the lower body portion 24 of the bridge 14, and which defines an internal water passage 48 for receiving water from the riser 12. Extending above the lower end portion 46 is an upwardly projecting main body portion 50 terminating at its upper end in an upstanding cylindrical support pin 52 adapted to be coupled to the brake assembly 22. The internal water passage 48 is formed to extend upwardly into the main body portion 50 to a point approximately mid way between the upper and lower ends of the posts 40 of the bridge 14, and then makes a substantially right angle turn to project laterally of the spinner body 44. Projecting outwardly in a lateral direction from the spinner body 44 is a tubular mounting extension, generally designated 54, internally forming an extension of the water passage 48, and which functions as a mounting for the reaction drive rotary nozzle assembly 18.

To rotatably secure the spinner assembly 16 to the lower body portion 24 of the bridge 14, the tubular lower end portion 46 is dimensioned to project through the bearing sleeve opening 36 into the interior of the lower body portion 24 of the bridge. Disposed in the central cavity 34 between the lower body portion 24 of the bridge 14 and the lower end portion 46 of the spinner body 44 is a cylindrical dynamic seal member 56 which functions to seal the spinner assembly against water leakage during operation. To retain the dynamic seal 56 in the central cavity 34, a cup-shaped cylindrical retainer 58 is press-fit within the passageway 26 of the lower body portion 24 below the seal, and is provided with a central opening 60 through which the bottom of the lower end portion 46 of the spinner body 44 projects. The central opening 60 is enlarged relative to the outside dimension of the lower end portion 46 to permit water from the riser 12 to flow therebetween into the central cavity 34.

The dynamic seal member 56 herein is provided with a pressure activated lip seal portion 62 disposed to engage the outside of the lower end portion 46 of the spinner body 44, and is defined by a downwardly and radially inwardly projecting annular lip which, when water pressure is admitted into the lower body portion 24 through the riser 12, is forced by hydraulic pressure into sealing engagement with the lower end portion of the spinner body, thereby to seal against the leakage of water therebetween. In this connection, it should be noted that due to the pressure actuation feature of the lip seal portion 62 of the seal member 56, which preferably is made of an elastomeric material, when pressurized water is initially admitted to the sprinkler 10 and before full line pressure is experienced, a small flow of water will pass between the lip 58 and the lower end portion 46 of the spinner body 44 so that any dirt or particulate material that may have entered the annular space between the lower end portion and the bearing sleeve opening 36 will be flushed upwardly out of the annulus, thereby to prevent such dirt from jamming or otherwise preventing the sprinkler from operating. To inhibit dirt from entering the annulus between the bearing sleeve opening 36 and the lower end portion 46, an enlarged radial flange 64 having a downturned rim 66 is formed at the base of the main body portion 50 of the spinner body 44, and is dimensioned to overlie and shield the upper end of the stepped cylindrical portion 32 of the bridge 14, as best can be seen in FIG. 3.

In accordance with one important aspect of the present invention, the reaction drive nozzle assembly 18 is mounted to the spinner body 44 in such a manner that the trajectory angle of the water spray 20 from the sprinkler 10 can be simply and easily selectively adjusted to meet a variety of user needs. Further, the nozzle assembly 18 permits a user to quickly and easily change the size and capacity of the sprinkler 10, even while the sprinkler is in operation.

Toward the foregoing ends, the nozzle assembly 18 includes a nozzle elbow 68 which is coupled to the spinner body 44 through the mounting extension 54 for quick and reliable rotary adjustment, and which can be locked in pre-set rotary positions corresponding to predetermined nozzle trajectory angles, in this instance, angles of 24°, 16°, 8° and −8° relative to a horizontal plane perpendicular to the axis of rotation of the spinner assembly 16. The nozzle elbow 68 is tubular in form having an inlet end portion 70 and an outlet end portion 72, and defines an internal water conduit 74 extending laterally from, and in axial alignment with the portion of the water passage 48 defined internally of the mounting extension 54, and which then bends to form a right angle turn in a direction generally tangent to the axis of rotation of the spinner assembly 16. Releasably coupled to the outlet end portion 72 of the elbow 68 is a nozzle member 76. As a result of water flow through the conduit 74 of the elbow 68 and the nozzle member 76, a reaction force tangent to the axis of rotation of the spinner assembly 16 is created, thereby to cause the spinner assembly and attached nozzle assembly 18 to rotate and spin relative to the support bridge 14.

As best seen in FIGS. 2 through 4, the inlet end portion 70 of the elbow 68 is telescoped within the mounting extension 54 which herein is formed as four cantilever finger-like arcuate segments 78, 80, 82, and 84 projecting laterally outwardly from the main body portion 50 of the spinner body 44. Each of the finger segments 78, 80, 82, and 84 is formed at its outer end with an inwardly projecting lip 86 defining a rearwardly facing shoulder 88, and which is adapted to abut a forwardly facing shoulder 90 formed by a radially outwardly extending flange 92 formed circumferentially around the inlet end portion 70 of the elbow 68, the position of the flange 92 on the elbow being selected such that when the inlet end portion 70 of the elbow is inserted into the mounting extension 54, the rearwardly facing shoulder 88 will snap-fit against the forwardly facing shoulder 90 and hold the inlet end of the elbow firmly against the inside wall of the water passage 48 adjacent its juncture with the main spinner body 44, thereby to provide a fluid seal to restrict water from escaping between the elbow and mounting extension. With this construction, the elbow 68 can be rotated within the mounting extension 54 to control the trajectory angle of the spray ejected from the nozzle member 76.

Circumferentially surrounding the mounting extension 54 is a locking collar 94 provided for releasably locking the elbow 68 in a selected rotary position. The locking collar 94 is slidably mounted around the mounting extension 54 for movement between a forward lock position, shown by the solid line position of FIG. 3, and a rearward unlock position, represented by the broken line position of FIG. 3. In the solid line lock position, the collar 94 prevents the finger segments 78, 80, 82, and 84 from radially expanding, while in the unlock, broken line position, the collar will allow the finger segments to undergo limited radial expansion.

As shown in FIG. 4, formed around the outer periphery of the flange 92 around the elbow 68, are two sets of multiple recesses 96, herein having a generally V-shaped cross section formed on diametrically opposed sides of the flange, and which are adapted to be engaged by a pair of radially inwardly projecting teeth-like tabs 100 formed along the inside of the elbow, one tab being herein formed on the finger segment designated 80 and the other on finger segment 84. Engagement of the tabs 100 in the recesses 96 serves as a detent means to locate and hold the elbow 68 in a selected rotary position relative to the mounting extension 54. To adjust the angle of the elbow 68, the locking collar 94 is moved rearwardly to the broken line position shown in FIG. 3, and the elbow is rotated, thereby causing the finger segments 80 and 84 carrying the tabs 100 to radially deflect and expand as the tabs snap from one recess to another. Once the desired angle of the elbow 68 has been reached, the lock collar 94 can be moved to the solid line position of FIG. 3 overlying the flange 92, thereby to prevent the tabs 100 from moving out of engagement within the selected recesses 96 by preventing the finger segments 80 and 84 from expanding in a radial direction.

As earlier noted, in this instance the elbow 68 is formed to be selectively adjustable for angles of inclination of 24°, 16°, 8° and −8° relative to the horizontal. This is achieved by selecting the location and number of recesses 96 of each set such that when the tabs 100 are received therein, the elbow will be inclined at the appropriate angle. It has been found that an angle of approximately 24° is generally suitable when the sprinkler 10 is to be used for spraying water over the tops of the trees in an orchard, such as for cooling the trees, while an angle of approximately 8° is particularly suitable for use in applying irrigating water below the tree canopy or in high wind conditions. The provision of a 16° angle is generally considered a good all-around angle of inclination for general purpose irrigation. Provision of a −8° angle (the condition illustrated in FIG. 2) is useful for situations when the sprinkler 10 is to be mounted in an inverted position, such as on a wheel-line or center-pivot type irrigation system. Thus, by allowing the nozzle elbow 68 to be adjusted for different spray angles, the useful applications for the sprinkler 10 of the present invention are significantly increased and enhanced. In this regard, it should be apparent that a wide variety of other spray angle adjustments can be provided simply by adding or changing the number and location of the sets of recesses 96.

Figure 6:
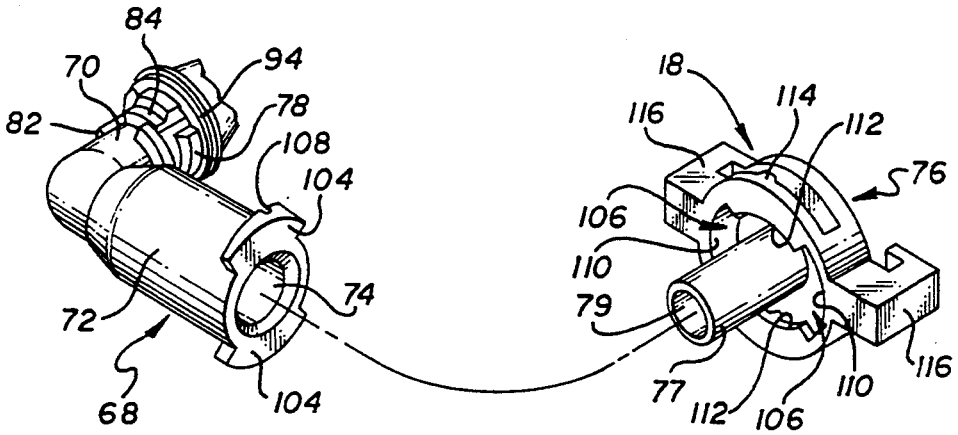
FIG. 6 is a fragmentary exploded perspective view of the nozzle assembly of the spinner type irrigation sprinkler of FIG. 2, and illustrating the connection between the nozzle elbow and nozzle member.

Moreover, the nozzle member 76 is releasably coupled to the elbow 68 in such a manner that it can be quickly and easily changed to permit a user to readily alter the irrigation characteristics of the sprinkler 10 to meet varying demands. Toward this end, the nozzle member 76 herein comprises a generally tubular body 77 having a converging nozzle outlet passage 79, and is secured to the outlet end 72 of the elbow 68 through a bayonet-type coupling 102, herein comprising a pair of radial ears 104 formed around the elbow which are friction fit into corresponding key-way type recesses 106 formed on the nozzle body, as best seen in FIG. 6. The ears 104 herein are wedge shaped and include a small detent 108 in their rearwardly facing wall. The key-way recesses 106 of the nozzle member 76 include a pair of diametrically opposed and enlarged arcuate openings 110 which are adapted to receive the ears 104 on the elbow 68, and intermediate wall portions 112 against which the wedge shaped ears engage when the nozzle member is rotated relative to the elbow. A pair of forwardly projecting nipples 114 are formed on the intermediate wall portions 112 which are adapted to snap-fit into the detents 108 on the ears 104 of the elbow 68, thereby to frictionally lock the nozzle member 76 in place on the elbow. To facilitate attachment to and removal of the nozzle member 76 from the elbow 68, the nozzle member is provided with enlarged radially projecting wings 116 which can be easily grasped to rotate the nozzle member relative to the elbow. Thus, provision of the bayonet-type coupling 102 permits a user to quickly and easily change the flow rate and capacity of the sprinkler 10 simply by removing one nozzle member 76 and replacing it with another, thereby further increasing and enhancing the usefulness and versatility of the sprinkler.

At this juncture, it should be noted that the reaction force causing rotation of the spinner assembly 16 is a function of the pressure of the water supplied to the sprinkler 10 and the size and capacity of the nozzle member 76 coupled to the elbow 68, the larger the supply pressure and/or the larger the nozzle size, the greater the reaction force created, and hence, the greater the rotational speed of the spinner assembly. It has been found that for maximum distance of water throw from the sprinkler 10, the rate of rotation of the spinner assembly 16 should ideally be maintained at a relatively low level, preferably on the order of about 10 rpm over the entire range of working supply pressures, typically from 25 to 50 psi, and nozzle sizes, typically from 0.3 to 2.5 gpm. In accordance with another important aspect of the present invention, the brake assembly 22 of the sprinkler 10 is capable of substantially slowing and controlling the rate of rotation of the spinner assembly 16 such that substantially maximum distance of throw is achieved over the entire range of typical supply pressures and nozzle sizes.

Toward the foregoing end, the upper end portion of the support pin 52 of the spinner body 44 is drivingly coupled to the brake assembly 22 which employs the principle of viscous shear to restrict and control the rate of rotation of the spinner assembly 16. Moreover, the brake assembly 22 is formed as a self-contained module which is releasably and removably attached to the support bridge 14 so that different modules having different braking characteristics can be selectively used for various nozzle sizes and/or supply pressures to achieve the desired rotation speed of the spinner assembly 16.

As best seen in FIGS. 1 through 4, the brake assembly 22 herein includes a main housing member 118 defining a central cylindrical chamber 120 within which is contained a viscous fluid 122 and a rotatable brake rotor 124. The support pin 52 of the spinner body 44 projects into the chamber 120 and is drivingly coupled to the brake rotor 124 so that as the spinner assembly 16 rotates, the brake rotor is rotated through the viscous fluid 122 which acts through viscous frictional shear to retard the rate of rotation of the spinner assembly.

In this instance, the housing member 118 of the brake assembly 22 is formed to have an upper or top generally elongated plate shaped portion 126 adapted to be releasably attached to the support bridge 14 by two downwardly projecting cantilever tabs 128 having out turned flanges 130 on their ends which snap-fit through cooperatively formed openings 132 in the support plate portion 42 of the bridge. Disposed radially inwardly of the tabs 128 is a first downwardly directed cylindrical flange 134 which is dimensioned to be snugly received within a cylindrical hole 136 formed centrally through the support plate portion 42 of the bridge 14, and which serves to locate and hold the brake housing 118 centered to the bridge.

The central chamber 120 of the brake assembly 22 is defined by a second downwardly directed cylindrical flange or wall 138 concentric with the first flange 134, and has an open lower end 140 to which is frictionally coupled an end cap 142 having a central aperture 144 therethrough for receiving the support pin 52. The end cap 142 herein has a peripheral lateral flange 146 adapted to overlie and abut the lower end 140 of the cylindrical wall 138, and an upwardly projecting skirt 148 dimensioned to be frictionally fit against the inside surface of the cylindrical wall, a small annular bead 150 being herein provided above the lateral flange 146 around the skirt 148 and which is adapted to be received in a corresponding annular recess 152 formed around the inside of the cylindrical wall to secure the cap to the housing 118. A cylindrical packing seal 154 is disposed radially inwardly of the skirt 148 to form a fluid tight seal around the support pin 52 when the brake assembly 22 is in operation, and a disc-shaped bearing 156 is disposed between the seal and the lower end of the rotor 124 to promote free rotation.

The brake rotor 124 is rotatably disposed within the chamber 120 of the brake assembly 22, and herein is formed as a pair of spaced concentric cylindrical sleeves 158 and 160, the outer sleeve 158 being integrally attached to the inner sleeve 160 by a series of arcuately spaced radial webs 162, herein four equally spaced webs, extending adjacent the bottoms of the cylindrical sleeves. Spaces formed between the webs 162 permit the viscous fluid 122 within the chamber 120 to circulate between the inner and outer cylindrical sleeves 158 and 160. Projecting downwardly from the housing 118 radially inwardly of the second wall 138 is a third cylindrical flange 164 which extends into the annular space between the inner and outer cylindrical sleeves 158 and 160 of the brake rotor 124 to provide, in addition to the inside surface of the second cylindrical wall defining the chamber 120, stationary surfaces adjacent the rotating surfaces of the rotor for producing a shearing action in the viscous fluid 122. Preferably, the various components of the brake assembly 22 are formed of molded plastic, with the exception of the packing seal 154 which is preferably formed of an elastomeric material. Notably, although the brake rotor 124 herein is shown as formed of plastic, other materials, such as metal, can be used, and the rotor can take other shapes, such as a solid cylinder or a series of vertically spaced horizontal disks.

To drivingly couple the support pin 52 of the spinner body 44 to the brake rotor 124, the inside surface of the inner cylindrical sleeve 160 is formed with a central, generally cylindrical opening 166 having diametrically opposed longitudinally extending flats 168 formed along the length, and which cooperate with corresponding flat surfaces 170 formed along the upper portion of the support pin, the opening and flats being dimensioned to frictionally receive the support pin thereby to couple the pin to the rotor and prevent the support pin from rotating relative to the brake rotor. Viscous shearing action created by the brake rotor 124 turning within the viscous fluid 122 is transmitted through the drive connection with the support pin 54 to the spinner body 44 to produce a retarding force slowing the rate of rotation of the spinner assembly 16.

The viscous fluid 122 disposed within the chamber 120 can be of any suitable type for producing the desired viscous shear retarding action, and it has been found that a methyl silicone material marketed by William F. Nye of New Bedford, Mass. having a viscosity rating of 600,000 centi stoke is particularly well suited for general applications, although viscosity ranges of between 100,000 and 10 million centi stoke may also be satisfactory, depending upon the effective braking area of the brake rotor 124, and the supply pressures and nozzle sizes used, the larger the brake area and/or the lower the supply pressure and smaller the nozzle size, the lower the viscosity level required. By way of example, it has been found that with a supply pressure range between 25 psi and 50 psi, using the foregoing 600,000 centi stoke viscous fluid 122 in the chamber 54 produced a rotational speed of between 3 rpm and 17 rpm with nozzle sizes in the range of between 0.3 gpm and 1.5 gpm. By increasing the viscosity of the viscous fluid 122, similar rotational speeds can be achieved for higher pressures and larger nozzle sizes. Notably, without the brake assembly 22 used in the foregoing example, it was found that the rotational speed of the spinner assembly 16 would be between approximately 2000 rpm and 3000 rpm, and the distance of water throw from the sprinkler would be reduced by approximately fifty percent over that achieved with the brake assembly coupled with the spinner body 44.

It should be noted that due to the high viscosity of the fluid 122 within the chamber 120, the foregoing structure alone has been found to be sufficiently fluid tight to prevent significant leakage of viscous fluid from the chamber. It should be readily apparent, however, that should leakage occur, such as when the sprinkler 10 has not been in use for prolonged periods, further seals can be added to prevent leakage, such as by the addition of a packing seal, for example an O-ring seal, positioned between the upper end of the inner sleeve 160 and the portion of the housing 118 forming the closed end of the chamber 120.

As previously indicated, one advantage of the brake assembly 22 of the present invention is that it is formed as a removable module enabling a user to select different braking capabilities to suit the particular supply pressure range and/or nozzle size range to be used. Thus, for very large supply pressures and/or large nozzle sizes, the brake assembly 22 can be altered by increasing the diameter of the second cylindrical wall 138 forming the chamber 120, thereby to increase the size of the chamber, and increasing the size and surface area of the brake rotor 124, for example by adding a third concentric cylindrical brake sleeve. Since such a size change does not affect the attachment of the brake assembly housing 118 to the support plate 42 of the bridge 14, nor the connection of the support pin 52 of the spinner assembly 16 to the brake assembly, different brake assemblies can be readily substituted to meet varying demands simply by releasing the tabs 128 of one brake assembly from engagement with the support plate 42, removing the brake assembly upwardly from the bridge 14 to slide the support pin 52 out of engagement with the rotor 124, and then inserting the new brake assembly module in its place.

In accordance with a still further feature of the present invention, the vertical posts 40 of the support bridge 14 are constructed to reduce interference with the water spray 20 from the rotating nozzle 76, thereby to increase sprinkler effectiveness by reducing the stream brake-up and close-in water fall out typically found in spinner type sprinklers. Toward this end, the posts 40 are formed to have a generally triangular or wedge-shaped horizontal cross section, best seen in FIG. 5, but unlike conventional spinner posts, the diverging surfaces are formed to extend from an apex, designated 172, which is aligned with the direction of the water spray 20 exiting the nozzle 76.

More particularly, unlike conventional support bridge posts such as shown, for example, in U.S. Pat. Des. Nos. 259,438 and 4,660,766 which have wedge-shaped cross sections with the radially inner apex of the posts directed toward the axis of nozzle rotation, the posts 40 of the present invention are rotated so that the side walls 174 of each post converge inwardly to one apex 172 defining a vertical plane which extends in a direction tangent to the axis of rotation of the nozzle 76, and which extends through the nozzle outlet when the outlet is pointing in the direction of the posts. With this construction, the water spray 20 from the nozzle 76 will be smoothly split around the posts 40 over the side walls 174 with a minimum of water splash and disruption, thereby minimizing stream break-up and early water fall out and maximizing the distance of water throw from the sprinkler 10.

From the foregoing, it should be apparent that the present invention provides a sprinkler 10 which is very versatile and capable of meeting a wide variety of user demands. In this respect, the brake assembly 22 insures that the spinner assembly 16 will rotate at a very low speed to maximize distance of throw, and is adaptable to a wider range of nozzle sizes and supply pressures.

It has been found that use of the brake assembly 22 can increase the distance of water throw from the sprinkler 10 by as much as fifty percent over similar sprinklers without such brakes, and that the useful life of the sprinkler is substantially increased due to a reduction in bearing wear.

Moreover, the nozzle assembly 18 permits the rapid and easy adjustment of nozzle trajectory as well as nozzle size changes, thereby to increase the capacity and uses to which the sprinkler 10 can be put. It has also been found that the use of a rotating nozzle construction like that of the present invention will provide as much as a twenty percent increase in the distance of water throw as compared with prior art spinner type sprinklers employing a fixed nozzle which ejects a stream vertically for interception and lateral deflection by a rotating horizontal deflector.

While a particular form of the present invention has been illustrated and described, it will be apparent that changes and modifications therein can be made without departing from the spirit and scope of the invention as defined by the following claims.

I claim:

1. In an irrigation sprinkler of the spinner type having a stationary support bridge adapted to be coupled with a source of pressurized water, a spinner assembly mounted to the support bridge for rotation about a generally vertical axis and including a spinner body and a nozzle assembly coupled thereto, the nozzle assembly having a nozzle member disposed to extend tangentially of the axis of rotation for projecting a water spray outwardly away from the sprinkler in a generally horizontal direction, and a brake assembly mounted to the support bridge and to the spinner assembly for controlling the rate of rotation of the nozzle assembly, the improvement wherein:

said support bridge includes a pair of laterally spaced, generally vertically projecting support posts, said posts each having a generally triangular cross-section and disposed to have an apex lying in a plane extending in a direction parallel with said tangential direction of extension of said nozzle member.

2. The improvement as set forth in claim 1 wherein said nozzle member is releasably coupled to said nozzle assembly.

3. The improvement as set forth in claim 2 including means for selectively adjusting the angle of trajectory of said nozzle member relative to said vertical axis of rotation whereby the angle of said water spray projected by said nozzle member away from said sprinkler can be controlled.

4. The improvement as set forth in claim 3 wherein said nozzle assembly includes a generally L-shaped tubular elbow having a first end coupled to said spinner body to project laterally therefrom and a second end coupled to said nozzle member, and said means for selectively adjusting includes means for rotatably coupling said first end of said elbow to said spinner body.

5. The improvement as set forth in claim 4 wherein said means for rotatably coupling said first end includes a plurality of detent means formed between said elbow and said spinner body, said detent means being formed to releasably retain said elbow in one of a plurality of preselected rotary positions with respect to said spinner body.

6. The improvement as set forth in claim 5 including releasable lock means for locking said elbow to said spinner body in one of said preselected rotary positions.

7. The improvement as set forth in claim 6 including a releasable bayonet-type coupled formed between said nozzle member and said second end of said elbow whereby said nozzle member is removably coupled to said elbow.

8. The improvement as set forth in claim 7 wherein said brake assembly is removably coupled to said support bridge and to said spinner assembly.

9. The improvement as set forth in claim 8 wherein said brake assembly includes a brake housing defining a central cylindrical chamber therein; a brake rotor disposed for rotation within said chamber; and a viscous fluid contained within said chamber about said rotor, said housing being coupled with said support bridge and said rotor being coupled with said spinner assembly for rotation therewith.

10. An irrigation sprinkler of the spinner type comprising:

a stationary bridge having upper and lower ends separated by at least two generally vertically directed support posts, said lower end being adapted to be coupled to a source of pressurized water and having a water passageway extending through a portion thereof for communication with said source;

a spinner body mounted to said support bridge between said upper and lower ends and between said posts for rotation about a generally vertical axis, said body having a water passage for communication with said water passageway through said support bridge;

a reaction drive nozzle assembly coupled to said spinner body and defining a water conduit therethrough communicating with said water passage through said spinner body, said nozzle assembly including a nozzle member for projecting a water spray outwardly away from the sprinkler in a generally horizontal direction with respect to said vertical axis;

means for selectively adjusting the position of said nozzle member in one of a plurality of predetermined rotary positions relative to said spinner body for controlling the angle of trajectory of said water spray projected by said nozzle member away from said sprinkler relative to said vertical axis; and a brake assembly mounted to said upper end of said support bridge and coupled to said spinner body for limiting the rate of rotation of said nozzle assembly relative to said support bridge.

11. An irrigation sprinkler as set forth in claim 10 wherein said means for selectively adjusting the position of said nozzle member includes a generally L-shaped tubular elbow having a first end rotatably coupled to said spinner body to project laterally therefrom, and a second end extending generally tangentially relative to said vertical axis coupled to said nozzle member, whereby said nozzle member projects said water spray outwardly from said sprinkler in a generally horizontal direction tangent to said axis of rotation.

12. An irrigation sprinkler as set forth in claim 11 wherein said rotatable coupling between said first end and said spinner body includes releasable lock means for releasably securing said elbow in one of said plurality of predetermined rotary positions with respect to said spinner body and said vertical axis.

13. An irrigation sprinkler as set forth in claim 12 wherein said releasable lock means comprises a collar disposed about said first end of said tubular elbow, said collar being movable relative to said first end between a first lock position and a second unlock position.

14. An irrigation sprinkler as set forth in claim 12 wherein said rotatable coupling between said first end and said spinner body includes detent means for releasably locking said elbow in one of said plurality of predetermined rotary positions.

15. An irrigation sprinkler as set forth in claim 12 including means for removably coupling said nozzle member to said second end of said elbow.

16. An irrigation sprinkler as set forth in claim 15 wherein said means for removably coupling said nozzle member comprises a bayonet type coupling formed between said elbow and said nozzle member.

17. An irrigation sprinkler as set forth in claim 10 wherein said brake assembly is removably coupled to said bridge and to said spinner body.

18. An irrigation sprinkler as set forth in claim 17 wherein said brake assembly includes a housing defining a cylindrical chamber therein, said chamber having a brake rotor disposed for rotation therein and filled with a viscus brake fluid, said rotor being coupled with said spinner body for rotation therewith.

19. An irrigation sprinkler as set forth in claim 18 wherein said support bridge includes:

a generally horizontally disposed base portion at said lower end;

said support posts each extending upwardly from said base portion and being off-set from said axis of rotation; and a generally horizontally extending top portion at said upper end supported by said posts to extend over said spinner body, said brake assembly being removably coupled to said top portion.

20. An irrigation sprinkler as set forth in claim 19 wherein each of said support posts has a generally triangular shaped horizontal cross-section with an apex defining a generally vertical plane extending tangentially relative to said axis of rotation.

21. An irrigation sprinkler as set forth in claim 11 wherein said spinner body includes a generally tubular mounting projection extending laterally with respect to said axis of rotation, and said first end of said elbow is formed to be telescopically received with said mounting projection.

22. An irrigation sprinkler as set forth in claim 21 including means for removably coupling said nozzle member to said second end of said elbow.

23. An irrigation sprinkler as set forth in claim 22 wherein said means for removably coupling said nozzle member comprises a bayonet type coupling formed between said elbow and said nozzle member.

24. An irrigation sprinkler as set forth in claim 10 wherein said brake assembly includes a brake housing defining a central cylindrical chamber therein; a brake rotor disposed for rotation within said chamber; and a viscous fluid contained within said chamber about said rotor, said housing being coupled with said support bridge and said rotor being coupled with said spinner assembly for rotation therewith.

25. An irrigation sprinkler as set forth in claim 24 wherein said support bridge includes a lower body portion at said lower end and a pair of vertically projecting support posts, said posts being laterally spaced from each other and from said axis of rotation and supporting a generally horizontally disposed top plate at said upper end of said bridge overlying said spinner assembly, said brake housing being coupled to said top plate with the axis of said cylindrical chamber aligned with said axis of rotation, said spinner assembly including a support pin upstanding along said axis of rotation from said spinner body and coupled to said brake rotor within said chamber.

26. An irrigation sprinkler as set forth in claim 25 wherein said brake rotor comprises at least two concentric and radially spaced cylindrical sleeves interconnected by arcuately spaced radial ribs, said support pin being coupled with the inner sleeve.

27. An irrigation sprinkler as set forth in claim 26 wherein said viscous fluid is sealed within said chamber and said brake rotor is releasably coupled with said support pin, thereby forming said brake assembly as a module removable from said sprinkler.

* * * * *